United States Patent [19]

Burgeson et al.

[11] 4,277,768

[45] Jul. 7, 1981

[54] SUPERCONDUCTING MAGNETIC COIL

[75] Inventors: John E. Burgeson; Dennis W. Lieurance, both of San Diego, Calif.

[73] Assignee: General Dynamics Corporation, San Diego, Calif.

[21] Appl. No.: 963,556

[22] Filed: Nov. 24, 1978

[51] Int. Cl.[3] ..... H01F 7/22

[52] U.S. Cl. ..... 335/216; 336/228; 336/234; 336/DIG. 1; 176/3

[58] Field of Search ..... 176/1-5, 176/9; 335/216; 336/228, 234, DIG. 1, 174

[56] References Cited

U.S. PATENT DOCUMENTS

| | | | |
|---|---|---|---|
| 3,332,047 | 7/1967 | Borchert | 335/216 |
| 3,434,047 | 3/1969 | Brickner | 336/234 |
| 3,514,730 | 5/1970 | Kassner | 335/216 |
| 3,778,343 | 12/1973 | Coppi et al. | 176/3 |
| 3,913,044 | 10/1975 | Albrecht et al. | 335/216 |

FOREIGN PATENT DOCUMENTS

| | | | |
|---|---|---|---|
| 4316030 | 11/1966 | Japan | 336/DIG. 1 |
| 1062406 | 3/1967 | United Kingdom | 336/DIG. 1 |

OTHER PUBLICATIONS

Conceptual Studies of TF Magnet for TEPR, Final Report 11/1/76, Contract E(40-1)-5154, pp. 3-2-3-7.

IEEE Pub. No. 75CH1097-5-NPS (11/75) Bushnell pp. 496-498.

IEEE Pub. No. 75CH1097-5-NPS (11/75) Lousteau et al., pp. 366-369.

RL-76-038 (4/76) Wilson et al., pp. 4-4.2, FIGS. 4, 5a, 5b, 5c.

ORNL-TM Contract W-7405-eng-26 (8/75) Roberts et al., pp. 5-27-5-28.

ANL/CTR-75-2 (75) pp. IV-41, 42, 60, 61.

IEEE Pub. No. 75CH1097-5-NPS (11/75) Hay et al., pp. 1130-1134.

*Primary Examiner*—S. A. Cangialosi

*Attorney, Agent, or Firm*—John R. Duncan; Hugo F. Mohrlock

[57] ABSTRACT

A superconducting coil, suitable for generating a magnetic field within a nuclear reactor, wherein a structurally continuous disk helix is utilized to carry a plurality of parallel superconductor windings thereon. The structure provides an improved support to the superconductor windings to more positively prevent stresses or small movements that would cause the superconductor to go normal.

6 Claims, 22 Drawing Figures

SUPERCONDUCTING MAGNETIC COIL

BACKGROUND OF THE INVENTION

Intensive research is presently underway to obtain fusion energy from the nuclear reactions of light elements, such as isotopes of hydrogen or helium, in a controlled manner so that this energy may be used for generating electric power. The nuclear reactors now in use for generating electric power operate by fission in which heavy nuclei are broken up into fission-fragment nuclei, whereas fusion reactors would operate by fusion of light nuclei in which energy-rich light nuclei are fused together to form heavier and less energy-rich fusion products.

A fusion reactor has some distinct advantages over a fission reactor. Whereas the fission process yields radioactive end products of high biological hazard and long life, the ashes of fusion would be non-radioactive nuclei, and there would be no problem of disposal of radioactive waste products. The fuel for a fusion reactor is in unlimited abundance. Isotopes of hydrogen such as deuterium may be obtained from water. And finally, controlled nuclear fusion reactors are safe to operate because only a small amount of fuel is contained within the reactor at a given time, thereby eliminating the possibility of an explosive, or runaway reaction.

To achieve controlled fusion it is necessary to heat a gas to extremely high temperature to form a plasma to initiate the reaction, and then contain the plasma without appreciable loss for a sufficiently long time to yield a net power output. The containment of this hot plasma, having a temperature in excess of 100 million degrees Kelvin, is a formidable undertaking. No material is available for constructing a container that would not be melted by this hot plasma.

Plasma is composed of an equal mixture of positively charged nuclei and free electrons. To maintain the plasma purity it can't be allowed to contact any other matter. Thus, it must be contained in a hermetically sealed vacuum chamber, and the fusible nuclei must not be allowed to touch the chamber walls before they have had sufficient opportunity to collide and fuse. However, at fusion temperature the nuclei are moving so rapidly they would travel from wall to wall of any chamber of practical size in less than a millionth of a second.

Thus, a nonmaterial means must be found to contain the plasma from contact with the chamber walls long enough for a net release of fusion power. One approach is to employ a magnetic field to confine the hot plasma. A circular ring of plasma is generated and maintained within a toroid or a doughnut shaped region by the action of intense magnetic fields shaped to form the toroid. The magnetic field acts as a nonmaterial container liner that insulates the hot plasma from the container walls. The magnetic field exerts an effective pressure on the contained plasma that is proportional to the square of the magnetic field strength. By maintaining this magnetic pressure at a greater value than the internal pressure of the plasma, containment is possible.

It may therefore be understood that it is necessary to develop a means for generating a high density magnetic field that is shaped to form a toroid insulating liner within a structural toroid, the magnetic field being of sufficient intensity to contain the hot plasma therein.

SUMMARY OF THE INVENTION

The invention relates to nuclear fusion reactors for the generating of electric power, and more specifically to superconducting coils utilized to form a specifically shaped magnetic field within the reactor container.

The invention comprises a coil of superconducting and copper conductors arranged in a new and unique manner that affords a greatly increased structural ability to withstand the enormous magnetic loads created by the coil. This is particularly important in terms of structural rigidity, because even the smallest of conductor slippage will generate sufficient caloric input into the superconductor to cause it to go "normal" or quench, thereby stopping its superconductive characteristics.

It is therefore an object of the invention to provide a coil having a cross section with superior strength and stiffness to react coil bending moments due to in-plane and out-of-plane forces as well as coil axial tension loads.

It is also an object of the invention to provide a coil having an improved structural arrangement that results in lower stresses or a reduction in required material.

It is also an object of the invention to provide a coil having a copper and stainless steel matrix for supporting and restraining the superconductor to prevent superconductor slippage.

Another object of the invention is to provide a redundant coil structure having multiple load paths, so that failure of any member will not result in an unsafe structure or a structural failure.

Another object of the invention is to provide a coil having a plurality of parallel superconductor windings which are current sharing. This plurality of conductors allows each to be sized or graded proportionally to the loading carried by the superconductor, which is a function of its radial distance location in the coil.

The above objects and others are accomplished by the present invention by utilizing a new and novel coil arrangement wherein a structural helix comprising a stainless steel and copper matrix firmly contains a plurality of parallel superconductor coils.

BRIEF DESCRIPTION OF THE DRAWINGS

The advantages of the present invention reside in the construction and cooperation of elements as hereinafter described, reference being made to the accompanying drawings which show the preferred embodiments of the invention, wherein.

DETAILED DESCRIPTION OF THE INVENTION

Figure 1:
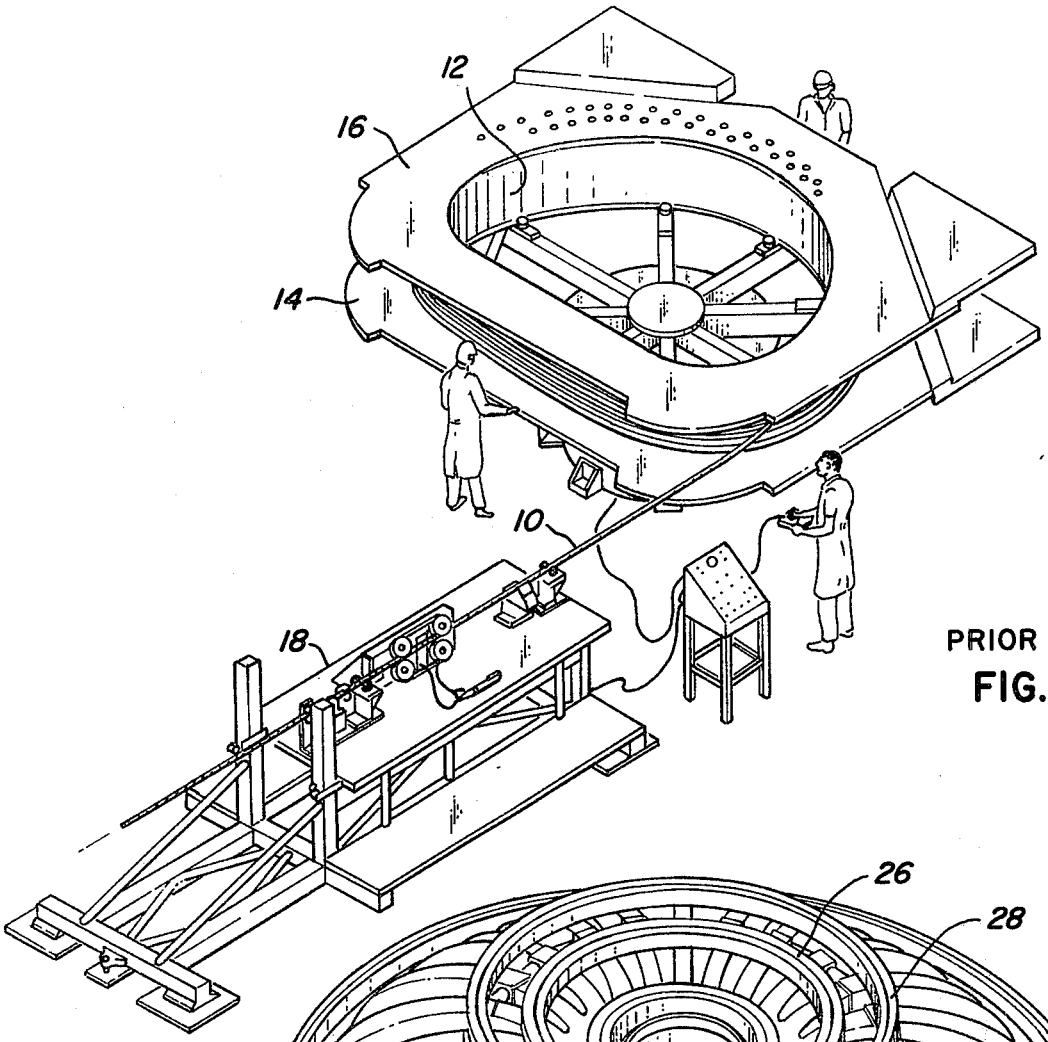
PRIOR ART FIG. 1
FIG. 1 illustrates the prior art windings of a coil.

The present invention is an electric coil for the generation of a high density magnetic field. The coil operates on the principle of superconductivity. Superconductivity is a state of matter which many elements and alloys enter when cooled to extremely low temperatures, wherein their thermal, electric, and magnetic properties are considerably different from their properties in the normal state. The temperature below which a substance is superconducting is called the transition temperature. One of the striking characteristics of a superconducting material is that when it is cooled below the transition temperature it loses all traces of resistance to the flow of electricity. As long as the temperature is kept below the transition temperature a persistent current will flow indefinitely in a ring or coil after the battery or other source of power is removed, showing that the resistance in the superconductor is not merely small, but is zero for all practical purposes.

Materials displaying this characteristic are called superconductors. The majority of known superconductors have transition temperatures that lie somewhere between 1° Kelvin and 10° K. Of the elements, tungsten has the lowest, 0.015° K., and niobium the highest, 9.5° K. Since liquid helium, having a boiling point of 4.2° K., is one of the most practical coolants to utilize, it is desirable that any alloy to be used have a transition temperature greater than 4.2° K. Considerable effort has gone into attempts to find superconductors with higher transition temperatures. An alloy of niobium, aluminum, and germanium, Nb(Al,Ge), having a transition temperature of 21° K., is the highest alloy developed to date.

A superconducting material can be forced into a normal state below its transition temperature by a sufficiently high magnetic field or by a large enough electrical current flow density passing through the material. Therefore each superconducting material has its own interdependent parameters of transition temperature, magnetic field, and electrical density which must be maintained at relative minimums to keep the material in a superconducting state. If any of these parameters are exceeded, the material will go normal.

Additionally, any candidate material must have certain desirable physical characteristics including strength, formability, machineability, etc. Alloys such as Nb-Ti, $Nb_3Sn$, $Nb_3Al$, $Nb_3Ge$, and $V_3Ga$, have satisfactory characteristics for use as superconductors in coils. Of these Nb-Ti and $Nb_3Sn$ are used in the preferred embodiment of the coil described herein, and they are among the most available from superconductor manufacturers at this time.

Copper and copper alloys are excellent normal conductors of electricity, and it is standard practice to provide a sufficient area of copper in a coil, wired in parallel with the superconductor, to allow the copper to carry the electrical load at any time the superconductor quenches or goes normal. When the superconductor is superconductive (at zero resistance) it carries the entire electrical load at greatly increased efficiency.

Referring to the drawings in detail, FIG. 1 illustrates the prior art wherein a coil is being wound with a conductor 10. The first row of conductor 10 is rolled tightly against the inner spindle wall 12, with the end walls 14 and 16 restraining the ends of the row. Subsequent rows are tightly wound one on top of the other until the coil is filled. A table 18 is equipped with inspection devices to assure proper characteristics of the conductor 10, and tensioning devices are provided to cause the proper preloading of the conductor on the coil.

Various conductor embodiments may be employed. For example, the conductor 10 may comprise a copper core with the superconductor strands twisted or braided around the outside, or the conductor may comprise a core of superconductor strands encased in a jacket of copper.

Figure 2:
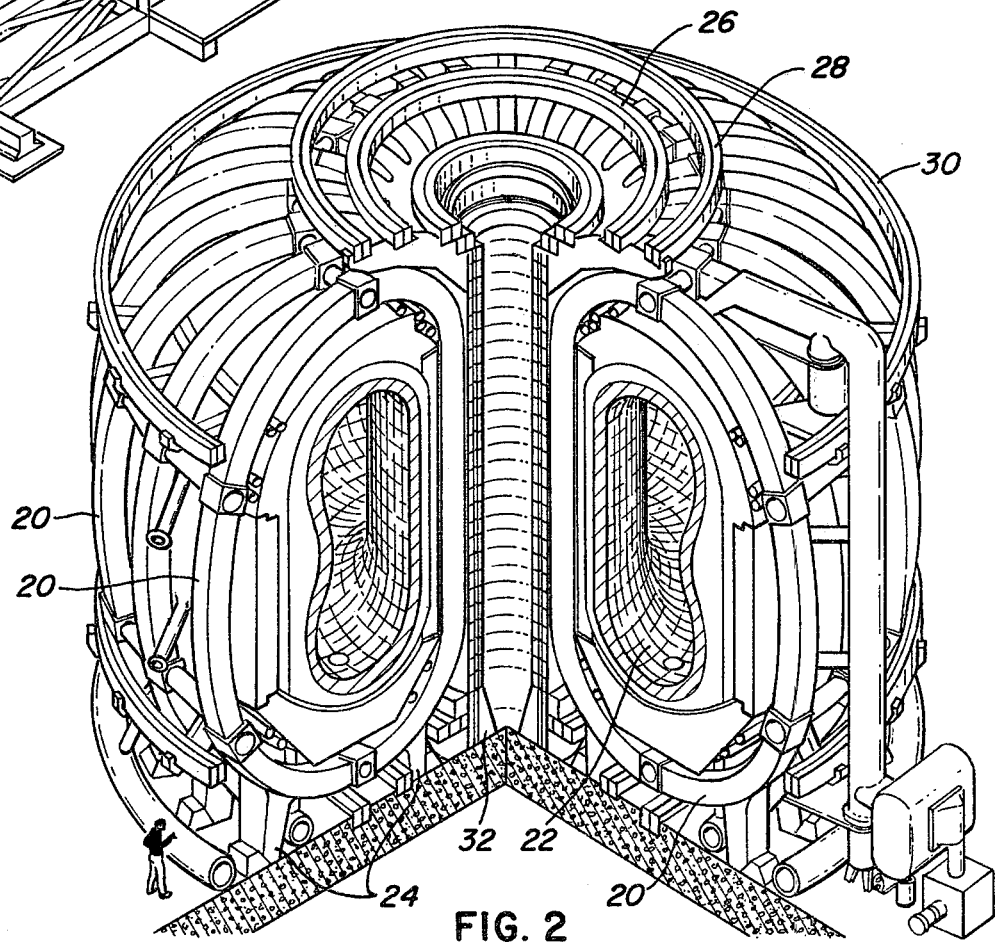
FIG. 2 is a cutaway view of a power reactor.

FIG. 2 is a cutaway view of the reactor, wherein a plurality of magnetic coils 20 are schematically shown disposed around a toroid plasma chamber 22. A heavy support structure, partially removed for clarity, is utilized to position the coils 20. A lower structure 24 supports the coils, while a plurality of trim or pulse rings 26, 28 and 30 circle the coils 20 for trimming or shaping the magnetic field. A center bucking post 32 provides the inner support structure, and each of the coils 20 are keyed to the bucking post 32.

Figure 5:
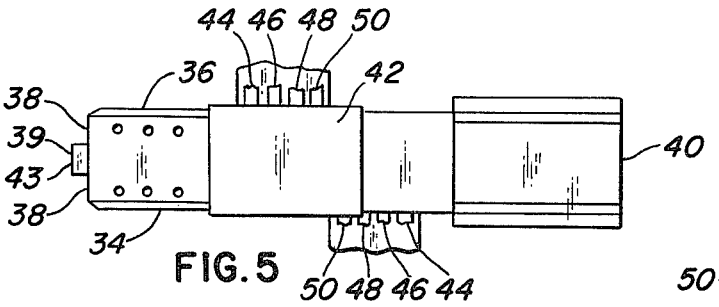
FIG. 5 is a top view of the coil.
Figure 3:
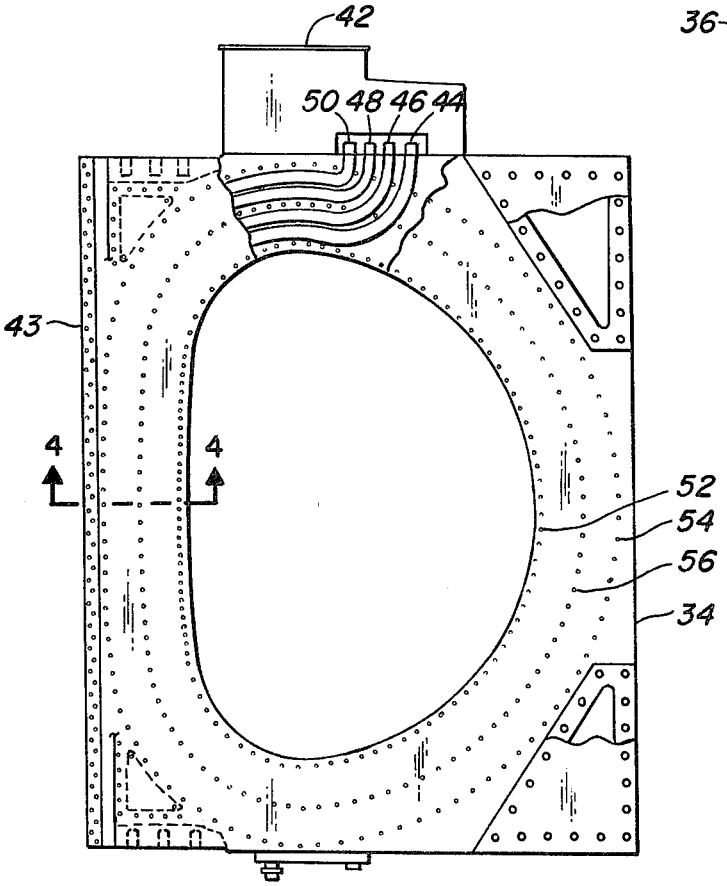
FIG. 3 is a side elevation view of the superconducting coil.
Figure 4:
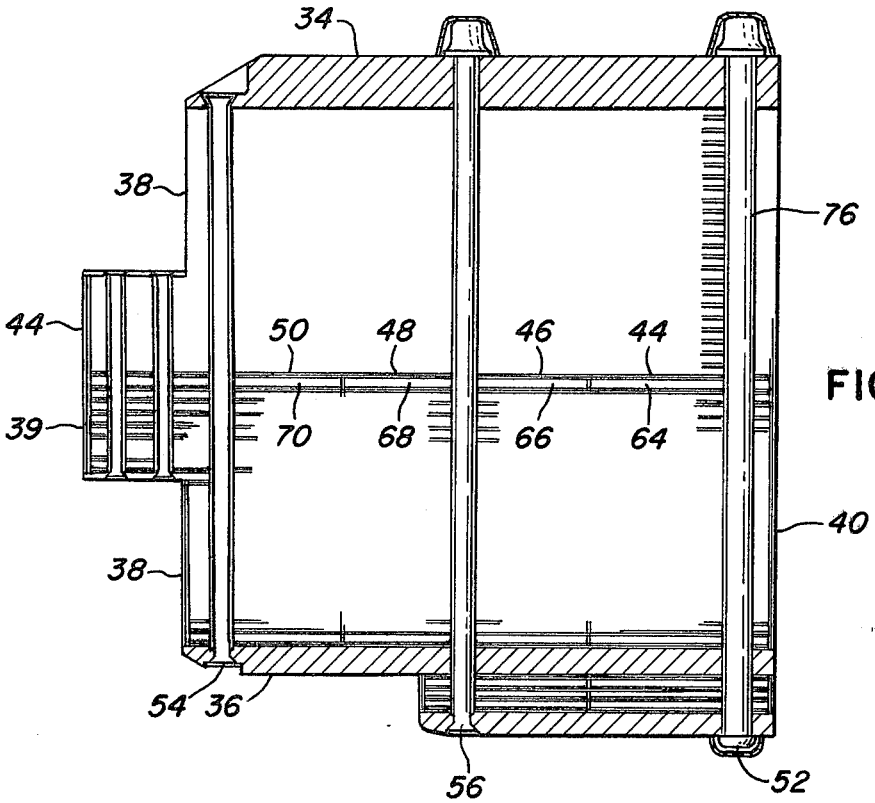
FIG. 4 is a cross-section view of the coil pack taken substantially along a plane shown by line 4—4 in FIG. 3.

Referring now to FIGS. 3, 4 and 5 it will be observed that the cross-section of the coil is of a generally rectangular shape, which is defined by side plates 34 and 36, inner edge plates 38 and 39, and outer edge plate 40. These plates are welded together to form a leakproof container for holding liquid helium. A pool boiling reservoir 42 is located at the top of the container to provide a reservoir of liquid helium and to collect gaseous helium that is produced from any boiling of the liquid.

Figure 6:
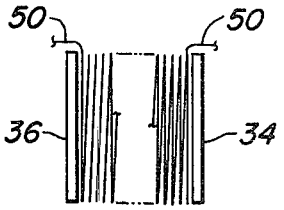
FIG. 6 is a schematic presentation of the helical windings of the coil.

Four concentric superconductors 44, 46, 48, and 50 are disposed within the coil, each entering the coil in the area of the pool boiling reservoir 42. Each superconductor is a flat tape, ribbon, cable, or braid which is carried by a helical structural matrix of many turns, somewhat similar to a slinky toy, as shown schematically in FIG. 6. The four superconductors then leave the opposite side of the coil in the area of the pool boiling reservoir 42, best seen in FIGS. 5 and 6.

Three rows of bolts extend through the side plates and the internal pack, an inner row of bolts 52, an outer row of bolts 54, and a center row of bolts 56. The thick side plates 34 and 36 provide a uniform compression load to the coil internal pack because of the high preload of these three rows of bolts.

Figure 7:
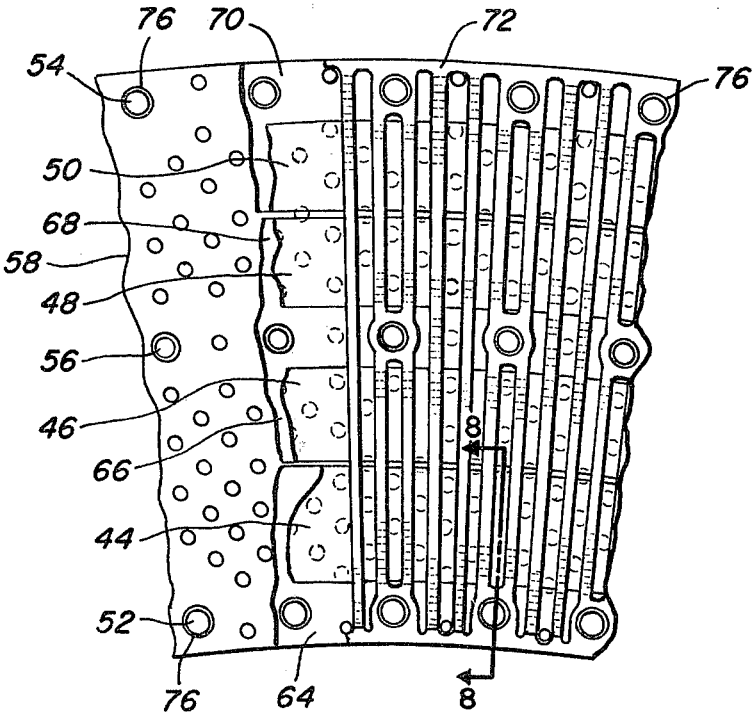
FIG. 7 is a partial view of one of the coil helical windings illustrating the laminated construction of the windings.

FIG. 7 shows a portion of the four superconductors 44, 46, 48 and 50 and the structural matrix which supports them. A stainless steel structural disk 58 is provided with a plurality of holes 60 which are to allow easy flow of the liquid helium throughout the coil. The disk 58 is the full depth of the coil cross-section and completes one helix revolution around the coil where it is welded to the next disk. Each disk is shaped similar to a split spring lock washer, the starting end of one disk welded to the terminating end of the preceding disk to form a helix of many turns. Laminated directly on top of the disk 58 are four copper conductors 64, 66, 68 and 70. The conductors may be made from a plurality of washers welded together in a manner similar to the disk 58, or formed from continuous lengths of conductor, depending on their size and the coil shape. After the disks and conductors have been fabricated into a helix having the required number of windings, continuous lengths of each of the four superconductors, 44, 46, 48 and 50 are then inlaid on the top sides of their respective conductors. The top and final lamination comprises an insulator 72, which may be of any suitable material such as a glass reinforced epoxy resin.

Figure 9:
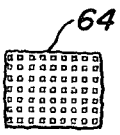
FIG. 9 is a partial side view of the conductor cooling fins and liquid helium passages taken from a plane shown as line 9—9 in FIG. 8.
Figure 8:
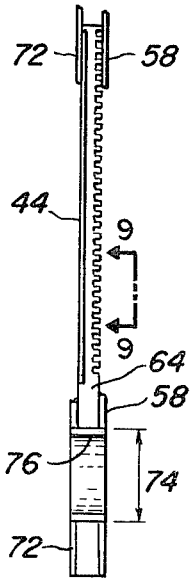
FIG. 8 is a cross-section view through the inner conductor and superconductor taken substantially along a plane shown by line 8—8 in FIG. 7.

FIG. 8 is a cross-section of the matrix in the area of conductor 64 and superconductor 44. The copper conductor 64 is shaped to form a raceway for containing the ribbon superconductor 44, which may be bonded to the conductor raceway by several means such as for example solder. The opposite side of the conductor 64 is of a waffle pattern, best seen in FIG. 9. This waffle grid provides free and easy circulation of liquid helium between the conductor 64 and disk 58. The disk 58 and conductor 64 are match bored to diameter 74 and an insulating bushing 76 is pressed into the bore 74. This serves to insulate the conductor and disk from the through-bolt 52.

Figure 11:
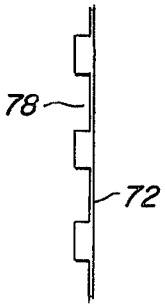
FIG. 11 is a partial end view of the edge of the coil winding insulator taken from a plane shown as line 11—11 in FIG. 10.
Figure 10:
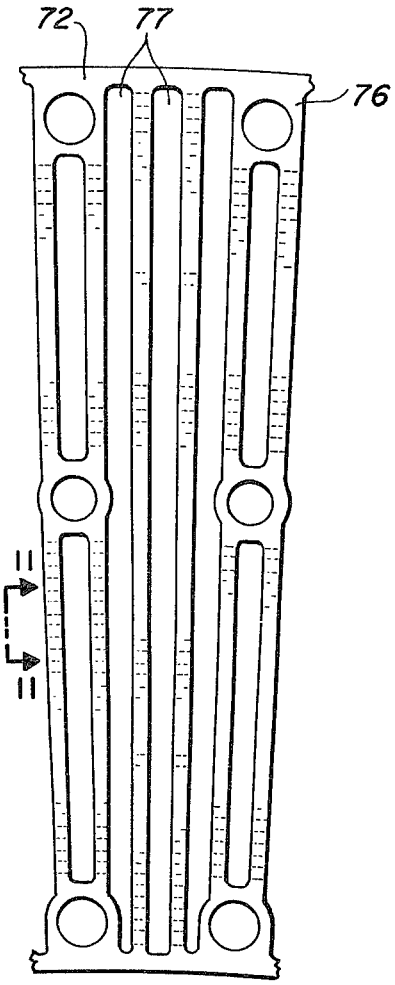
FIG. 10 is a view of a portion of the coil winding insulator.

FIGS. 10 and 11 show the insulator 72 in more detail, wherein it may be seen that cutouts 77 allow free and easy flow of liquid helium in one direction and slots 78 provide free flow in another direction. It should be understood that in addition to the insulated bushings 76 and disk insulator 72 other local insulation may be employed where needed to electrically isolate the coil windings from the outer container and other structure, and such insulation, which is well known to those skilled in the art, is not shown in the drawings for clarity.

Figure 14:
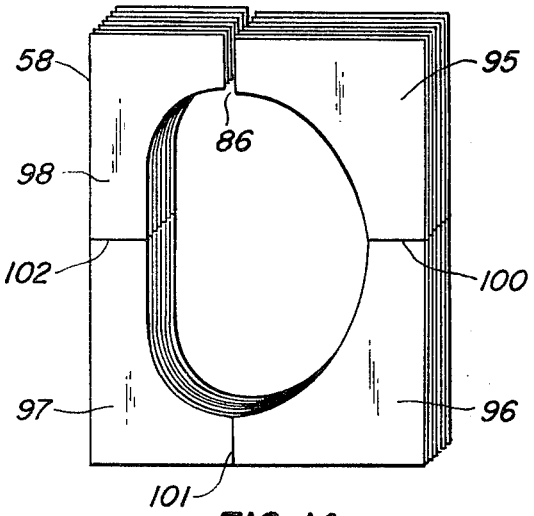
FIG. 14 is a view of a helical stack of split disks.

Additionally, in some applications it may be desired to electrically isolate the disk 58 from the conductors 64, 66, 68 and 70. In such a case a layer of insulation may be interposed between the disk and conductors. Such an embodiment introduces an induction problem however, because the disk windings will act as the secondary winding in an induction coil. Fluctuating current or fast shutoff of current in the conductor-superconductors will induce a high emf in the disk windings. It will be recalled that each disk 58 was earlier likened to a split lockwasher used under a bolt head or threaded nut, and each end of a disk was welded to a mating end of the next disk to develop the helical windings. If, instead of "splitting" the disk, the disk was "slotted" then a gap would exist between mating ends of successive disks. This would break the continuity of the disk windings and overcome the induction problem. Such a stack of disks is schematically shown in FIG. 14. The slot 86 in each disk may coincide in each disk as shown in FIG. 14, or may be staggered, or stair-stepped around the helix spiral.

Figure 15:
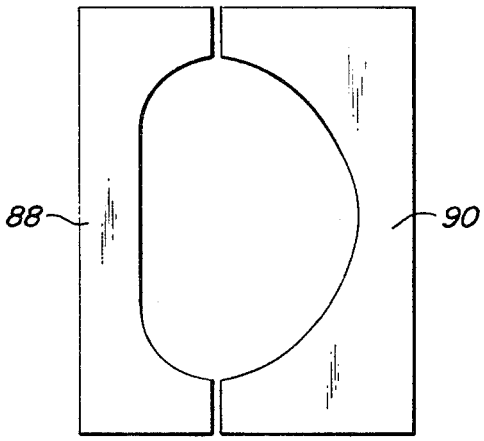
FIG. 15 illustrates a two-piece disk split vertically.
Figure 16:
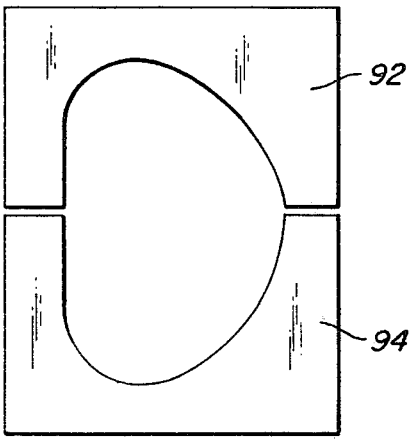
FIG. 16 illustrates a two-piece disk split horizontally.

It also should be understood that for ease of manufacture or other considerations the disk may be made in more than one piece, as for example in FIG. 15 where the disk is split or slotted into a left piece 88 and a right piece 90. Likewise, the disk may be divided as shown in FIG. 16 into a top piece 92 and a bottom piece 94. Any number and combination of splits and slots may be utilized. In FIG. 14, for example, each disk 58 comprises four pieces 95, 96, 97 and 98, which are welded together at splits 100, 101 and 102 to form a disk 58 having a slot 86.

It should be understood that the conductors 64, 66, 68 and 70 may be constructed of other metals which are of suitable structural characteristics balanced with good conductivity, and likewise the structural disk 58 may be made from other suitable structural metals. The low resistance of copper in the normal state and the high strength of stainless steel at cryogenic temperatures makes these two materials preferred for the conductors and the coil structure respectively.

From the foregoing it should be understood that the coil comprises a helix of many turns, each turn having a flat or elongated rectangular cross-section. Each turn of the helix is a lamination comprising a stainless steel structural lamination, a layer of copper conductors which are fitted or inlaid with superconductors, and a top insulation layer. This laminated helix construction provides a superior structural coil, since the stainless steel side plates, the stainless steel disk, and the copper conductor all work together to react the coil axial, torque, shear and bending loads. The coil cross-section moment of inertia, about both axes, is much larger than a conventional thick case coil with internal windings such as is shown in FIG. 1.

The through-bolts 52, 54, and 56 support each coil turn and compress the coil pack, thereby tightly supporting the steel helix disks and conductors to prevent conductor slippage. This firm support is a very important feature, since even the smallest slippage of the conductor can generate sufficient heat at these extremely low temperatures to cause quenching of the superconductor locally and thereby cause it to go normal. Slippage of the conductor is caused by the very large loads which are imposed on the structure, which may for example be as high as five thousand or more pounds per lineal inch of the conductor.

Figure 12:
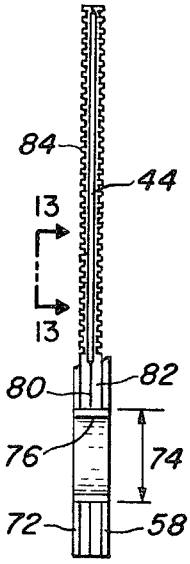
FIG. 12 is a cross-section view of an alternate arrangement of the conductor and superconductor.
Figure 13:
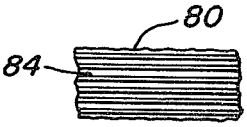
FIG. 13 is a partial side view of the conductor cooling fins and liquid helium passages taken from a plane shown as line 13—13 in FIG. 12.

An alternate embodiment of the coil helix is shown in FIGS. 12 and 13. Here the copper conductor 64 comprises two halves 80 and 82 with the superconductor 44 sandwiched between. This arrangement provides for four-side retainment of the superconductor and permits cooling fins on both sides of the copper conductor. Also, instead of the waffle pattern of cooling fins shown in FIG. 9, the fins 84 in FIG. 13 run circumferentially around the conductor 80. In such an arrangement the fins contribute their cross-section area to the conducting of electrical current, which is not possible with the waffle fins of FIG. 9, however liquid helium flow is more directional with the circumferential fins than with the waffle fins.

Four conductors and superconductors are shown herein, however it should be understood that any number may be employed with good results. The strength of the magnetic field across the coil cross-section drops off toward the outer edge, and the purpose of using a plurality of conductors/superconductors is so that they may be graded for this variation. The innermost superconductor 44 operates in the highest magnetic field and therefore must have the lowest electrical density flow in order to stay within the previously described parameters for superconductivity. This requires either more cross-sectional area or a different material than the outermost superconductor 50 which operates in a lower magnetic field. Thus, each superconductor may be varied or graded to provide the highest efficiency for its particular magnetic environment. For example, inner superconductor 44 may be Niobium Tin ($Nb_3Sn$) while outer superconductor 50 might be Niobium Titanium (NbTi).

It should be understood that whatever number of superconductors are employed each superconductor should carry the same current, albeit at different electrical current density flow. One method for assuring equal current in each parallel superconductor is to employ separate power supplies to each superconductor, thereby forcing an equal current through each of the parallel superconductors. Another method would be to transpose each superconductor back and forth radially through both low and high field regions. Such transposition of individual filaments or strands within a given superconductor may also be utilized to force equal current sharing by each individual strand, and will be described hereinafter.

Most superconductors comprise a plurality of individual strands or filaments arranged in a manner which can be classified as one of three general types: monolithic, braided, or cabled. A monolithic superconductor comprises strands or filaments which are electrically contiguous and uniformly dispersed throughout the cross sectional area of the superconductor.

Figure 17:
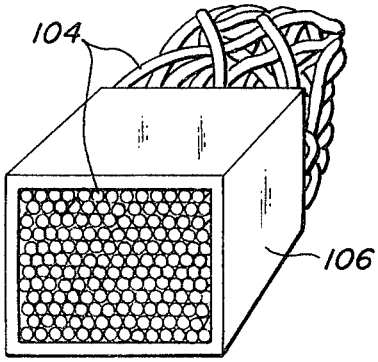
FIG. 17 illustrates a portion of a jacketed braided superconductor.

FIG. 17 illustrates a typical braided superconductor, wherein a plurality of insulated strands 104 are interwoven together and encased in a jacket 106. Each strand 104 comprises a superconducting material which has been coated with a non-superconducting material, such as copper or chrome for example, to function as an electrical insulator. The outer jacket 106 is made from a non-superconducting material, such as stainless steel for example, to function as an electrical insulator and to mechanically protect and compress the bundle of strands 104.

Figure 18:
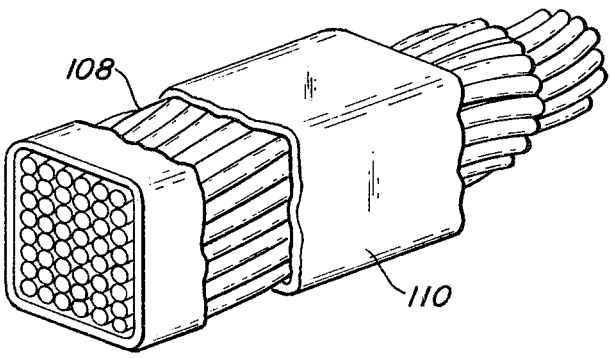
FIG. 18 illustrates a portion of a jacketed twisted cable superconductor.

FIG. 18 illustrates a typical cabled superconductor, wherein a plurality of insulated strands 108 are twisted around each other and encased in a jacket 110, the materials for the strands and the jacket being substantially the same as the braided superconductor shown in FIG. 17. The strands are usually compacted together by swaging down the outer jacket, such as by passing the assembly through a plurality of sizing dies or by rolltrusion.

Figure 19:
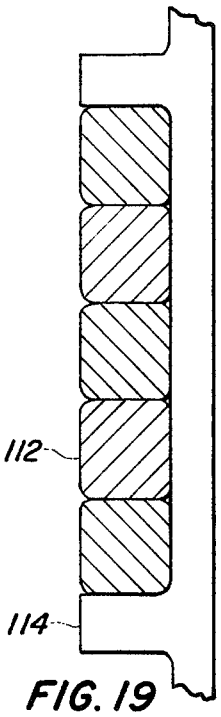
FIG. 19 is a cross-section of a conductor raceway containing a plurality of substantially square superconductors.

FIG. 19 illustrates a plurality of square jacketed superconductors 112 which have been inlaid into the raceway of a conductor 114. In order to obtain maximum efficiency each of these jacketed superconductors 112, which may be the monolithic, braided, or cabled type previously described, would have to be graded, since each is disposed on the conductor 114 at a different radial distance. Because of the large number of jacketed superconductors 112 required for inlaying on four or more conductors per winding, grading of each superconductor 112 is not practical.

Figure 20:
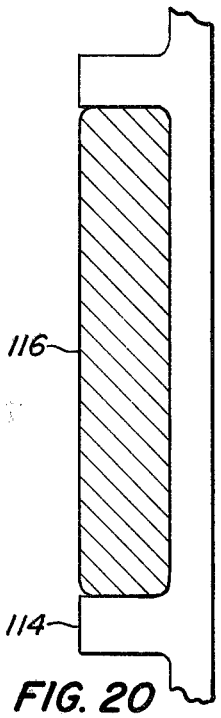
FIG. 20 is a cross-section of a conductor raceway containing a single rectangular superconductor.

FIG. 20 illustrates a single rectangular jacketed superconductor 116 inlaid into the raceway of a conductor 114. In such an embodiment the efficiency of the superconductor 116 is a more pronounced function of the type of strand arrangement employed. If a monolithic arrangement was employed, where all strands are electrically contiguous, the performance would be least efficient. This is because each strand in the superconductor is located at a different radial distance, and therefore to improve efficiency each strand would need to be insulated and graded.

In order to have a more efficient superconductor each strand of the superconductor should be insulated and transpose the full width of the superconductor. An ideal superconductor would be arranged such that each strand snaked through the superconductor something like a sine wave having an amplitude equal to the superconductor width. Such a fully transposed superconductor would yield uniform current since each insulated strand would pass through the same total magnetic field.

Returning to FIGS. 17 and 18 it can be seen that the braided arrangement yields a superconductor wherein each strand is partially transposed, while the cabled arrangement has full transposition in the outer strands and decreased transposition of the strands toward the center of the bundle. At the exact center the core strand has no transposition.

Figure 21:
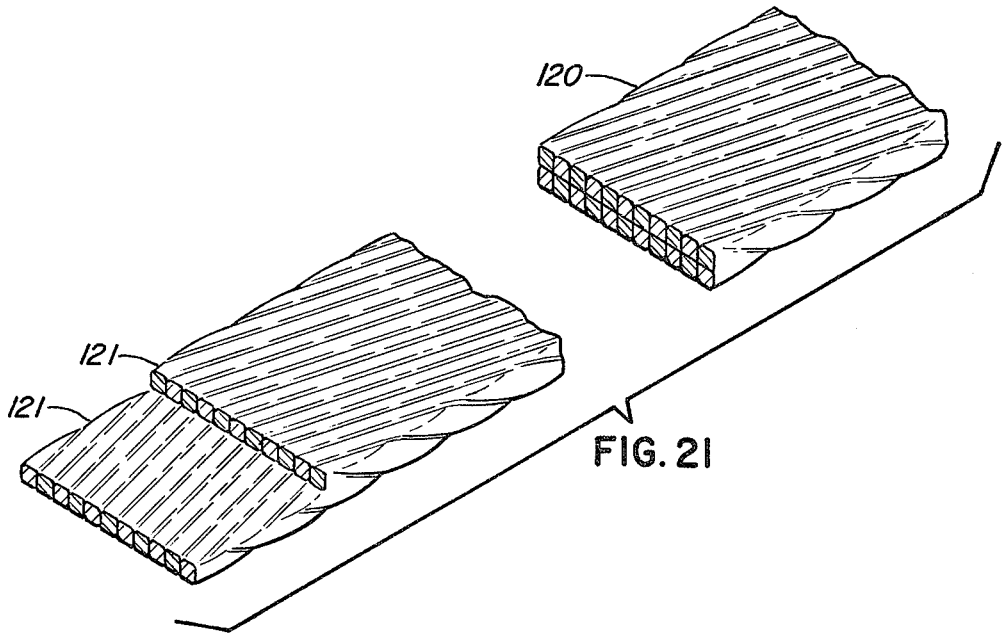
FIG. 21 illustrates a portion of a fully transposed cable superconductor.

FIG. 21 illustrates a fully transposed cable superconductor 120 comprised of a plurality of strands 121. Each strand 121 is the outer strand of a twisted cable. The arrangement is easily understood if one visualizes a plurality of parallel strands helically wrapped on a cylindrical mandrel. The mandrel is then removed and the resulting hollow cylinder of strands is mashed flat. Such a fully transposed cable 120 is two strands thick, and a thicker superconductor can be made by stacking a plurality of these cables 120 on top of each other.

Thus it can be seen that the winding shown in FIGS. 8 and 12 has a thin rectangular superconductor 44 which is well adapted for utilizing the highly efficient fully transposed cable arrangement shown in FIG. 21. Another benefit of full transposition is that all strands experience the same overall mechanical deformation during the compaction phase of fabrication, and thereby a superconductor is produced wherein each strand has substantially the same mechanical as well as electrical properties.

Figure 22:
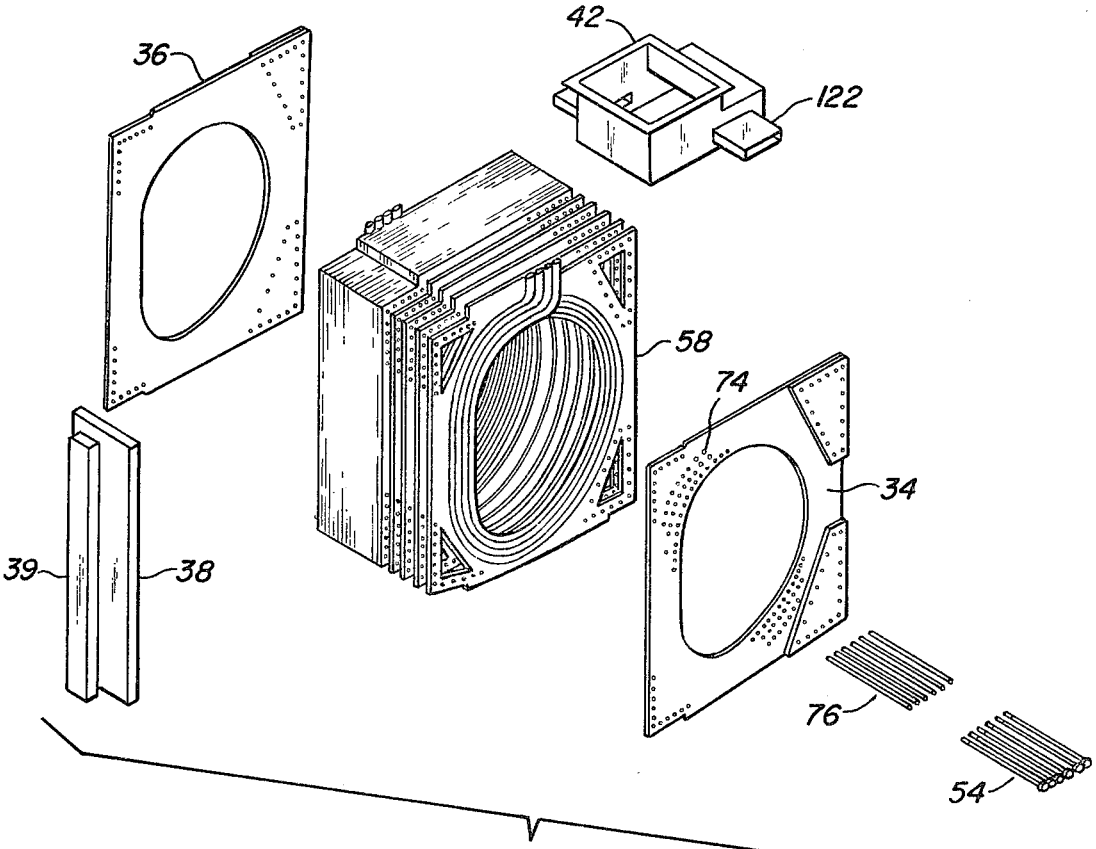
FIG. 22 is an exploded view of the coil assembly.

FIG. 22 is an exploded view of the superconducting coil. The disks 58 have been stacked one upon another with their mating ends welded together, or with the prescribed gap between mating ends as previously described. The conductors 64, 66, 68 and 70 have been formed into continuous lengths or welded into continuous lengths, and their respective superconductors have been inlaid thereon, and the conductors and the insulators 72 have been laminated between windings of the disks 58.

The bushing holes 74, see FIGS. 8 and 12, are either precision located in each of the side plates 34 and 36, disks 58, insulators 72, and conductors 64, 66, 68 and 70, or line reamed on assembly. The bushings 76 are then inserted in the bushing holes 74, and the bolts 54 are inserted into the bushings 76. After the stack has been compressed by tightening fully all bolts 52, 54, and 56, the edge plates, such as plate 38, are attached to the side plates 34 and 36, such as by welding, to close the container. Additional items such as bucking post key 43 and reservoir 42 are then attached. The resulting structure is highly compact and affords rigid support for the conductors and superconductors. Pool boiling reservoirs 42 on each coil are interconnected by cable tunnels 122, which contain the conductors and are filled with cryogenic liquid such as liquid helium.

From the foregoing description it may be seen that an improved superconducting coil has been invented which provides an improved structural arrangement for efficiently carrying the high loads imposed thereon and rigidly supporting the superconductors to avoid slippage. Positive support is provided the conductor and movement or slippage is prevented, by bolts going through the total thickness of the coil pack. The bolts going through the conductors react the conductors electro-magnetic loads to the disks and side plates. In addition, the clamp-up due to the through bolts preload/torque provides a high compression load to the coil pack, providing friction restraint. The thin stainless steel disks may be punched or blanked to shape, eliminating costly machining of conductor grooves in thick plates, because conductor containment grooves are not required with the present invention. Shimming of the conductor to obtain a tight pack is not required with the present invention. Present day coil embodiments usually employ shims to keep the conductor winding pack tight, due to build up of manufacturing tolerances.

The copper stabilizer conductor may be formed or machined to the coil shape, eliminating the need for a winding machine, such as shown in FIG. 1. There is no forming or bending of the copper stabilizer conductor after the superconductor is installed. Superconductors such as Nb Sn are brittle, and the amount of forming permitted is limited. However, an unsolder filled transposed cable or braid of Nb Sn is flexible, due to the small diameter of each strand. The unfilled superconductor is easily formed to the coil shaped copper stabilizer conductor and soldered in place. Present day coil embodiments such as shown in FIG. 1 for example, utilize a superconductor soldered to the stabilizer prior to winding. The coil winding strains on the composite superconductor/conductor result in high detrimental strains on the superconductor.

Further, it should be clear from the foregoing that the figures and description herein have been drawn to a particular coil embodiment, but the invention is not to be limited to the specific details, arrangement, materials, and number and shape of parts herein set forth, since various modifications, such as the alternate conductor arrangement shown in FIG. 12 for example, may be effected for other coil requirements without departing from the scope and spirit of the invention.

Having now described our invention so that others skilled in the art may clearly understand it, we claim:

1. A superconducting coil comprising:

a structural helix having a plurality of substantially flat windings;

a plurality of electrical conductors disposed on a surface of said structural helix windings, each of said conductors shaped to provide a raceway;

a plurality of electrical superconductors, one of said superconductors disposed within each of said conductor raceways;

each of said superconductors comprising a substantially transposed multi-strand superconductor;

an insulator disposed between each winding of said structural helix;

at least one radial slot in each of said structural helix windings;

a container surrounding said structural helix, said container adapted for the storage of a cryogenic fluid therein;

a plurality of insulation bushings disposed to pass through said structural helix; and a plurality of bolts disposed to pass through opposite sides of said container and located within said insulation bushings to firmly compress said container sides and said helix windings into a rigid pack.

2. The superconducting coil of claim 1 wherein said structural helix is made of stainless steel and is shaped to provide a plurality of holes for the free circulation of said cryogenic fluid.

3. The superconducting coil of claim 1 wherein each of said structural helix windings comprises a split plate formed to the pitch angle of said helix, said split forming a first and second end to each of said windings, and wherein said first end of one winding is joined to said second end of a contiguous winding to thereby form a continuous helix.

4. The superconducting coil of claim 1 wherein each of said conductors is formed to provide a plurality of fins disposed on at least one surface of said conductor to form passages for circulation of said cryogenic fluid.

5. A method of manufacturing a superconducting coil comprising:

(a) forming a plurality of first conductors into 360° segments of a helical winding;

(b) forming a plurality of second conductors into 360° segments of a helical winding;

(c) sandwiching superconductors between each pair of said first and second conductors to form conductor assemblies;

(d) inserting a radially slotted structural disk between each winding of said conductor assembly;

(e) inserting an insulation sheet between each winding of said conductor assembly;

(f) placing side plates on opposite ends of said conductor assembly;

(g) inserting insulated bushings through said conductor assembly and said side plates; and (h) compressing said side plates together by a plurality of bolts inserted in said insulated bushings.

6. The superconducting coil of claim 1 wherein each of said conductors assemblies consists of a pair of laminated electrical conductors with a channel therebetween and said electrical superconductor is disposed within said channel.

* * * * *